United States Patent [19]

Haas et al.

[11] 4,133,683

[45] Jan. 9, 1979

[54] AGGLOMERATION IMAGING METHOD

[75] Inventors: Werner E. L. Haas, Webster; Bela Mechlowitz, Rochester; James E. Adams, Ontario, all of N.Y.

[73] Assignee: Xerox Corporation, Stamford, Conn.

[21] Appl. No.: 327,333

[22] Filed: Jan. 29, 1973

[51] Int. Cl.[2] ..... G03G 13/22

[52] U.S. Cl. ..... 96/1 PS; 96/1R; 96/27 R; 427/145; 427/161

[58] Field of Search ..... 96/1 R, 1 PS, 27, 36; 117/1.7, 21, 93.3; 204/181; 250/475, 317

[56] References Cited

U.S. PATENT DOCUMENTS

| | | | |
|---|---|---|---|
| 3,396,401 | 8/1968 | Nonomura | 117/21 X |
| 3,653,885 | 4/1972 | Levy | 96/1 R |
| 3,729,334 | 4/1973 | Snelling | 96/1 R |
| 3,753,705 | 8/1973 | Goffe | 96/1 R |
| 3,960,555 | 6/1976 | Goffe | 96/1 PS |
| 4,029,502 | 6/1977 | Goffe | 96/1 PS |

*Primary Examiner*—Roland E. Martin, Jr.
*Assistant Examiner*—John L. Goodrow

[57] ABSTRACT

An imaging member comprising an agglomerable layer on a substrate is agglomerated in image configuration to cause the formation of larger agglomerates in the agglomerated areas which usually produces a relative transparentizing or a color change in the agglomerated areas. This imaging process is followed by contacting the imaged member, usually uniformly, with a solvent for the agglomerable material or a chemical reactant for the agglomerable material to dissolve away agglomerable material in the unagglomerated (which herein includes relatively unagglomerated compared to the agglomerated areas) areas or chemically react with agglomerable material in the unagglomerated areas, respectively at a faster rate than in the agglomerated areas.

18 Claims, 3 Drawing Figures

AGGLOMERATION IMAGING METHOD

BACKGROUND OF THE INVENTION

This invention relates in general to imaging and more specifically to a new agglomeration imaging system including a step of treating the agglomeration imaged member with a solvent or chemical reactant for said agglomeration material.

There has recently been developed an agglomeration imaging system wherein an agglomerable layer on and not embedded in a substrate is imagewise agglomerated for example by exposure to electromagnetic radiation of sufficient energy to cause the agglomerable layer to agglomerate to cause relative transparentizing, or color change and the formation of agglomerates in the exposed areas. Transparentizing or a color change is caused by the reduction of the effective cross-sectional area of the agglomerable layer in the imagewise exposed areas. Such an imaging system is disclosed in copending application Ser. No. 84,018, filed Oct. 26, 1970 allowed and awaiting issue.

Other agglomeration imaging system, where the agglomerable layer may be partially or completely embedded in a softenable layer, are disclosed in copending application Ser. No. 755,306, filed Aug. 26, 1968 and issued as U.S. Pat. No. 4,029,502 on June 14, 1977 and Ser. No. 862,907, filed Oct. 1, 1969 and issued as U.S. Pat. No. 3,753,705 on Aug. 21, 1973.

Another somewhat related disclosure is Haas, Adams and Mechlowitz U.S. Pat. No. 3,671,237, which while not directly related to agglomeration imaging does relate to removal of imagewise unexposed particles from a substrate.

Copending application Ser. No. 301,383, filed Oct. 27, 1972, allowed and awaiting issue discloses an agglomeration imaging system including a step of physically removing the agglomerates from the agglomerated areas of agglomeration images. This usually provides a positive image from a positive light image input i.e. the more transparent or lighter areas of the resultant image after removal of agglomerates are those that were exposed to the light image input.

While the above-mentioned agglomeration imaging systems described in aforementioned applications Ser. Nos. 84,018 (allowed and awaiting issue); 755,306 (U.S. Pat. No. 4,029,502) and 862,907 (U.S. Pat. No. 3,753,705) are most satisfactory systems and while the images produced thereby are entirely suitable for many imaging applications including use as projection transparencies, the resulting image in some cases while visible, may be of relatively low contrast density. For example where an amorphous selenium agglomeration layer is used the agglomeration layer is reddish black in color to start with and the image areas which are agglomerated may be changed only to a slight unaided human eye detectable change in the original reddish black color.

Thus, there is a need for providing an even higher quality agglomeration image.

Because Ser. Nos. 84,018 (allowed and pending issue); 755,306 (U.S. Pat. No. 4,029,502) and 862,907 (U.S. Pat. No. 3,753,705) produce the agglomeration images which are contrast enhanced by the process of the instant invention and because Ser. No. 301,383 (allowed and awaiting issue) is a related application, the disclosures of these four copending applications are hereby expressly incorporated herein by reference.

SUMMARY OF THE INVENTION

It is, therefore, an object of this invention to provide a method of agglomeration imaging which overcomes the above-noted deficiencies and satisfies the above-noted needs.

It is another object of this invention to provide a method of selectively dissolving or chemically reacting the unagglomerated portions of an agglomeration image comprising an agglomerable layer in image configuration and a complementary image configuration comprising larger agglomerates of said agglomerable layer both on a substrate.

It is a further object of this invention to provide a method of converting low contrast density agglomeration images to high contrast density images.

It is a further object of this invention to provide a method of converting, often dramatically, low contrast density agglomeration images to high contrast density images by completely dissolving away agglomeration material from the unagglomerated areas of the imaged member to leave the member in those areas the density of the substrate.

It is a further object of this invention to provide a method of converting, often dramatically, low contrast density agglomeration images to high contrast density images by contacting the agglomeration image with a chemical reactant for the agglomerable material to cause a chemical reaction (for example to convert the agglomeration material to a transparent or soluble reaction product) in the unagglomerated areas to leave the member in those areas the density of the substrate.

It is a further object of this invention to provide a method of producing agglomeration images of high contrast density with substantially complete transparentization in the unagglomerated areas, from agglomerable layers and material that may be incapable of being substantially transparentized by the agglomeration effect alone.

It is a further object of this invention to provide a method of producing agglomeration images of high contrast density where the image agglomeration step is capable of higher sensitivities because the image agglomeration step alone need not provide high contrast density images.

It is a further object of this invention to provide a positive-to-negative, negative-to-positive imaging system i.e., the more transparent or lighter areas of the resultant image after dissolving or chemically reacting according to this invention are those that were not exposed or relatively less exposed to the light image input.

The foregoing objects and others are accomplished in accordance with this invention as follows. An imaging member comprising an agglomerable layer on a substrate is agglomerated in image configuration to cause the formation of larger agglomerates in the agglomerated areas which usually produces a relative transparentizing or a color change in the agglomerated areas. This imaging process is followed by contacting the imaged member, usually uniformly, with a solvent for the agglomerable material or a chemical reactant for the agglomerable material to dissolve away agglomerable material in the unagglomerated (which herein includes relatively unagglomerated compared to the agglomerated areas) areas or chemically react with agglomerable material in the unagglomerated areas, respectively at a faster rate than in the agglomerated areas. The agglomeration imaged member comprises an agglomerable layer on a substrate; the agglomerable layer having been imagewise agglomerated to form agglomerates, which are also on the substrate, said agglomerates larger than the individual bits of the agglomerable layer used to form each agglomerate.

BRIEF DESCRIPTION OF THE DRAWINGS

For a better understanding of the invention as well as other objects and further features thereof, reference is made to the following detailed disclosure of this invention taken in conjunction with accompanying drawings wherein.

DESCRIPTION OF THE PREFERRED EMBODIMENTS

Figure 1:
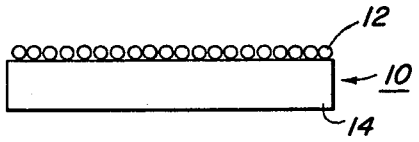
FIG. 1 is a partially schematic, cross-sectional view of an imaging member suitable for use in the present invention.

Referring now to FIG. 1 there is seen imaging member 10 comprising an agglomerable layer 12 on substrate 14. Any substrate which is capable of holding agglomerable layer 12 and which has sufficient mechanical strength to carry layer 12 in the imagewise agglomeration process used to form the imaged member described in FIG. 2 and in the solvent liquid or chemical reactant contact step of this invention may be used.

While FIG. 1 shows layer 12 not embedded in substrate 14 and this is preferred for ease of contacting layer 12 with a dissolving agent or a chemical reactant, the instant invention may be used with agglomerable layers which are partially embedded or even completely embedded in a supporting substrate or softenable layer for example as described in aforementioned Ser. Nos. 755,306 (U.S. Pat. No. 4,029,502) and 862,907 (U.S. Pat. No. 3,753,705).

When completely embedded, there must be a mechanism present e.g. in the solvent liquid or chemical reactant contacting step hereof which permits the solvent or the reactant to contact the agglomerable layer either directly or by diffusing through overlying substrate material. For example, a solvent for the substrate material combined with the solvent for the agglomerable material or the same as, could be used to wash away substrate material to bare sufficient agglomerable material to permit substantial dissolving away of agglomerable material. In addition, a completely embedded agglomeration image could be prepared for the solvent liquid or chemical reactant contact step hereof beforehand e.g. by contacting it with a solvent for the substrate material to bare agglomerable material.

Typically substrate 14 may be a metal layer, or paper or a plastic such as Mylar, a polyethylene terephthalate resin film available from duPont. Any suitable form, such as sheet, web, moebius strip may be used. Substrate 14 may also be a softenable type substrate e.g. like the softenable layer materials described in aforementioned Ser. No. 755,306 (U.S. Pat. No. 4,029,502) and 862,907 (U.S. Pat. No. 3,753,705).

Agglomerable layer 12 may comprise any suitable agglomerable material including electrical insulators, electrical conductors, photoconductive materials and non-photoconductive materials.

Agglomerate, agglomerable and the several variant forms thereof used herein defines the effect or capability of massing or fusing together of the imagewise agglomerated portions of layer 12 to reduce the cross-sectional area of the agglomerable layer in these portions, usually to partially transparentize or at least effect a human eye detectable color change of layer 12 in said portions, the color change apparently associated with the light scattering caused, for example, by the particles in the imaged areas of a particle layer 12 (see copending application Ser. No. 837,780, filed June 30, 1969 now U.S. Pat. No. 3,975,195); specifically including the massing together of closely packed particles into a smaller number of larger particles, which may be spherical, of less cross-sectional area.

In fact, greater sensitivities may be obtained for color changes as opposed to a change to near complete transparency, even though lower contrast density images are usually produced. The instant invention provides a means to convert these lower contrast density images to high contrast density images.

Preferred agglomerable materials for use herein, because of the excellent quality of the resultant images and because of the sensitivity of the system includes: amorphous selenium, amorphous selenium alloyed with arsenic, tellurium, antimony, bismuth, etc.; amorphous selenium or its alloys doped with halogens; tellurium, mixtures of amorphous selenium and one or more crystalline forms of selenium including the monoclinic and hexagonal forms, arsenic and zinc.

An optimum agglomerable material comprises predominantly, i.e., greater than 50% by weight, amorphous selenium.

It is found that especially suitable materials for layer 12 especially where the agglomeration image is formed by the preferred radiation exposure mode, generally have a low glass transition temperature (where the materials have a glass transition temperature at all) i.e., generally below about 50 or 60° C. and a high absorption coefficient for the radiation used, such as selenium.

Any suitable agglomerable material may be used in layer 12. Typical additional agglomerable materials include sulfur, dyed polyvinyl carbozole, gallium, cobalt tricarbonyl; thermoplastics or dyed thermoplastics such as polyoctylacrylate, polylaurylmethacrylate; dyed waxes, dyed paraffins, and others. Such materials may be dyed with any suitable material, such as phthalocyanine dyes, fluorescein dyes, or any other dye colorant; a host of materials suitable for use as such dyes is set forth in U.S. Pat. No. 3,384,488. In addition, the agglomerable material may comprise particulate material comprising an agglomerable matrix which contains smaller pigment particles. For example, the thermoplastic materials listed above are particularly suitable for such large particle matrices, while any suitable pigment such as zinc oxide, titanium dioxide, lead oxide, phthalocyanine pigments, or other suitable marking pigment may be used as pigment particles in the agglomerable matrix.

Agglomerable layer 12 is shown to be a microscopically discontinuous layer of closely packed particles. It is preferred for images of highest resolution, density and utility and to provide for the most sensitive system that layer 12 be a microscopically discontinuous layer and optimally that the layer 12 be particulate in order to best promote the agglomerating effect.

For best results layer 12 is preferably from about 0.01 to about 2 microns thick comprising particles of the same average size although about 0.05 to about 5 micron, or even thicker layers may give agglomeration images.

Even better layers in this regard are thin i.e., below about 1 micron and, optimally between about 0.1 and about 0.5 micron thick microscopically discontinuous particle layers of average particle size between about 0.1 and about 0.5 microns, comprising predominantly amorphous selenium, for example, vacuum evaporated by techniques as disclosed in Goffe et al. U.S. Pat. No. 3,598,644. Microscopically discontinuous layer 12 may also be formed by other methods such as cascading, dusting, etc., as shown in Goffe U.S. Pat. No. 3,520,681 or by stripping and other methods as described in copending application Ser. No. 685,536, filed Nov. 24, 1967 now abandoned or any other suitable method.

Especially suitable selenium films when viewed under a microscope at least show either a network of cracks or apertures or else a network of dark lines indicating a microscopically discontinuous layer. Electron micrographs show that optimum predominantly amorphous selenium films are actually composed of discrete spherical amorphous particles of an average particle size optimally between about 0.1 and about 0.5 microns.

It is preferred that particles of this optimum particle size have center to center, particle spacings of not greater than about ½ microns, although in some embodiments, larger particle-to-particle spacings are suitable. Closely packed particle agglomeration layers facilitate agglomeration.

Figure 2:
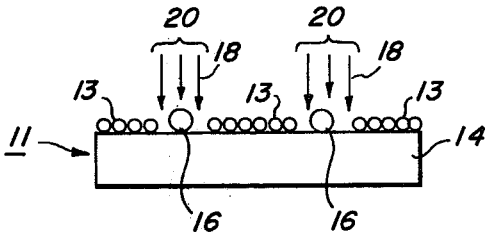
FIG. 2 is a partially schematic, cross-sectional view of the imaging member of FIG. 1 being agglomeration imaged, showing the resultant image of agglomerate areas 20 and unagglomerated areas 13.

Referring now to FIG. 2 there is shown the imaging member of FIG. 1 being imagewise exposed to radiation 18 which causes the agglomerable layer 12 in imagewise exposed areas to agglomerate to form agglomerates 16. Further particulars on this agglomeration imaging system may be found in aforementioned copending applications Ser. No. 84,018 (allowed and awaiting issue); 755,306 (U.S. Pat. No. 4,029,502) and 862,907 (U.S. Pat. No. 3,753,705).

Imagewise exposure typically comprises exposing the aforementioned imaging members with a short duration exposure of electromagnetic radiation of high intensity. Radiation of high intensity is intended to mean radiation with radiant energies in the range between about 0.001 and about 0.3 joules/cm$^2$ in exposures of duration in the range between about one and about $10^4$ microseconds, although in various embodiments, somewhat shorter or longer exposure durations may be suitable for the production of satisfactory images. This radiation also typically is of wavelengths in the range between about 2,000 Å and about 26,000 Å. The radiation sources useful in the present invention, such as Xenon flash lamps and lasers, typically emit radiant energy which comprises at least heat and light, as indicated by the wavelength and energy ranges above.

The short duration, high intensity, flash imaging technique is particularly advantageous because the energy imparted to the imaging member is not continuously applied and therefore has little time in which to be conducted away to other portions of the imaging member. The energy is so quickly applied to such localized areas of the imaging member, that the local effects occur before the energy has time to be conducted away from the imaged areas. These facts contribute to the high resolutions which are a characteristic result of the present imaging system.

It is seen that agglomeration causes reduction of the cross-sectional area of layer 12 by the formation of larger spheres 16 of the same mass as the total mass of the smaller particles of layer 12 which were agglomerated together to form the sphere 16, but taking up a smaller surface on substrate 14 than the total of the surface areas of the smaller particles of layer 12 which were agglomerated together to form each agglomerate.

The agglomeration of the individual particles of the agglomeration layer selectively reduces the density in image areas of the imaged member. In some modes the agglomerated areas are reduced to about zero agglomerable layer density, i.e., the resulting agglomerates are not visible to the naked eye and the only density left is that of the substrate. In other instances, generally of greater relevance to the instant invention, the agglomerated areas still have substantial agglomeration material density. The reduction in optical density in the agglomerated areas is due to the substantial reduction in the cross-sectional area of the agglomeration material on the substrate. The agglomerates of agglomerable layer material in the complete agglomeration mode are typically 5 to 10 times larger in diameter than the original agglomerable layer particles.

Figure 3:
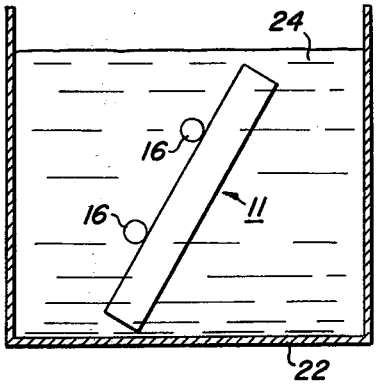
FIG. 3 shows one mode of dissolving unagglomerated areas by contacting the agglomeration imaged member 11 with a liquid solvent for the agglomerable material.

Referring now to FIG. 3 there is shown one mode of removing the unagglomerated areas 13 by contacting the agglomeration imaged member 11 with liquid 24 in beaker 22, liquid 24 being a solvent for the agglomerable material. This provides one method of contacting the imaged member with a solvent or a reactant to dissolve or react with the unagglomerated portions 13 of the agglomerable layer which as disclosed herein above in the preferred embodiment is comprised of small particles.

The solvent may completely remove the unagglomerated portions 13 of the agglomeration image 11 to leave the image in those areas the color and transparency of the substrate 14.

If solvent action is stopped after complete removal of portions 13, in many embodiments hereof, there is little or no unaided human eye detectable change in the density of the relatively more agglomerated portions 20 of agglomeration image 11. Thus for example where an amorphous selenium agglomeration layer is used, an agglomeration image 11 is formed with unagglomerated areas 13 looking reddish black in color and the agglomerated areas being only slightly lighter in color from the original reddish black color. The solvent removal, using such solvents as carbon disulfide, sodium sulfide and chromic acid, completely removes the original reddish black color to leave a dense image of areas slightly lighter than the original reddish black color of the agglomeration layer, and the color of the substrate 14 which may be transparent.

Similar results are achieved when instead of dissolving away unagglomerated portions 13, the agglomeration image 11 is contacted with a chemical reactant which will transform unagglomerated portion 13 into a transparent compound. For example for the optimum agglomeration layers herein comprising more than 50% by weight amorphous selenium contacting the agglomeration image with such materials as an alcohol solution of triphenyl phosphine will transform the amorphous selenium unagglomerated portions into a transparent selenium compound.

While it is often desirable to transparentize as discussed above it will also be appreciated that it may be desirable to, instead of transparentizing, create a different colored reactive product for example to create a colored image in a colored background.

Some treatments according to this invention will produce a chemical reactant which is soluble in the same agent which produced the chemical reaction or in a solvent which may be applied in a following step.

It will also be appreciated that while we have spoken largely of color or transparency changes which are visible to the human eye the invention hereof may be used to change other characteristics of an agglomeration image such as in the dissolving mode to use a conductive agglomerable material on an insulating substrate to create a printed circuit.

It will be understood by those skilled in the art that any suitable method of applying the solvent or chemical reactant may be used including spraying, brushing and so on.

It is clear that the dissolving away of material portions of unagglomerated areas of an agglomeration image or reacting these areas with any agent which changes the color or any other human eye or machine detectable characteristic of unagglomerated areas to a different degree than any similar change in the agglomerated areas is contemplated by this invention.

The following examples further specifically define the present invention of dissolving or chemically reacting the unagglomerated areas of an agglomeration image. The parts and percentages are by weight unless otherwise indicated. The examples below are intended to illustrate various preferred embodiments of the process of this invention.

EXAMPLE I

An imaging member like that illustrated in FIG. 1 is prepared by vacuum evaporating a microscopically discontinuous layer of amorphous selenium, approximately 0.2 microns in thickness, on a Myler substrate. The vacuum evaporation process is carried out by the process disclosed in Goffe el al. U.S. Pat. No. 3,598,644, with the process carried out on the Mylar substrate of this Example, as opposed to the softened substrates of U.S. Pat. No. 3,598,644, to form a layer of amorphous selenium particles residing on the surface of the Mylar.

This imaging member is then exposed to an optical image by providing over the surface of the imaging member an optical mask, here in the form of a resolution target, and the imaging member is exposed at a distance of about 3 inches, by radiant energy in the illuminated areas of about 0.2 joules/cm$^2$ by flashing a Novatron Xenon flash lamp available from the Xenon Corporation, for a time duration of about 50 microseconds. The xenon lamp has an emission spectrum in the range between about 2,000 and 25,000 Å.

This method provides a faithful image replica on the imaging member of the optical image mask. The low contrast, unaided human eye detectable image comprises less dense i.e. lighter colored areas of selenium in the exposed areas where the microscopically discontinuous selenium layer has agglomerated and fused into particles of less total cross-sectional area, with the background portions of the imaging member comprising the original density of the microscopically discontinuous selenium layer. Using collimated monochromatic projection input light at about 5,800 angstroms from a Bausch and Lomb monochromator and a photodiode on the other side of the imaged member, transmissiveness of the imaged member in agglomerated areas is measured to be about 20% of the input radiation and in unagglomerated areas about 7% of the input radiation.

The imaged member is than dunked for about two seconds in a sodium sulfide solution made by dissolving about one part of sodium sulfide in about 20 parts of water and removed. The unagglomerated areas show the striking effect of having all the selenium removed to leave a bare Mylar substrate. The agglomerated areas show little or no unaided human eye detectable change from their agglomeration image condition. A high contrast image results. Transmissiveness of the unagglomerated areas is then measured by the same technique as described in the previous paragraph and is shown to have been dramatically increased to near 100%.

EXAMPLE II

Example I is followed except that instead of dissolving the unagglomerated portions by dunking in a sodium sulfide solution, a swab of cottom soaked in sodium sulfide solution is lightly hand wiped once over the imaged member to dissolve the unagglomerated selenium in the unexposed areas.

In copending application Ser. No. 301,383 (allowed and awaiting issue) as described in the Examples, dunking in a liquid or swabing with a liquid removed the agglomerated areas. Usually dunking in Ser. No. 301,383 (allowed and awaiting issue) is associated with some back and forth or vibratory or agitating movement of the member while in the liquid to cause relative movement between the agglomerated areas and the liquid as one skilled in the art would know was intended in Example I of Ser. No. 301,383. If the result of the instant invention is intended, dunking with no agitation and swabing at lighter pressures than used in Ser. No. 301,383 (allowed and awaiting issue) should generally be used.

Given these surprising results i.e., that the unagglomerated areas can be selectively dissolved or chemically reacted at a materially faster rate than agglomerated areas of the agglomeration layer, it may be postulated as the reason for this result that the unagglomerated areas present a much greater effective surface area for the reaction whether it be a chemical reaction or dissolving action.

Although specific components and processes have been stated in the above description of preferred embodiments of the unagglomerated dissolving or chemical reacting system of this invention, other suitable materials and processes as listed herein, may be used with similar results and various degrees of quality.

In addition, other materials and methods which exist presently or may be discovered may be used to synergize and enhance or otherwise modify the invention.

For example, the initial image agglomeration may take place by techniques other than flash exposure to electromagnetic radiation. Imagewise heating the agglomerable layer by contact or convection or imagewise softening the agglomerable layer by softening vapors may be used. The initial image agglomeration may also take place by addressing with a pulsed or modulated steered laser.

While the agglomerates hereof have been shown and described herein as being spherical and while it is thought that complete agglomeration does form spherical agglomerates, it should be understood that especially for less than complete agglomeration, other than spherical agglomerates may be formed and are intended to be included in the term agglomerate as used herein and in Ser. No. 301,383 (allowed and awaiting issue).

It will be understood that various other changes in the details, materials, steps and arrangements of parts which have been herein described and illustrated in order to explain the nature of the invention, will occur to and may be made by those skilled in the art upon a reading of this disclosure and such changes are intended to be included within the principle and scope of this invention.

What is claimed is:

1. In an agglomeration imaging method of the type wherein an imaging member comprising an agglomerable layer, on a substrate, comprises agglomerable material and is imaged to provide a first portion of said agglomerable layer with agglomerable material in one of non-agglomerated and agglomerated states said first portion being in image configuration, and a second portion of said agglomerable layer being in a complimentary image configuration and comprising agglomerates of said agglomerable material which are larger in size than agglomerates, if any, of said agglomerable material in said first portion; the improvement of image contrast, wherein the improvement comprises: contacting said imaged member with a liquid solvent or a chemical reactant for said agglomerable material to dissolve or chemically react with the first portion of said agglomerable layer at a faster rate than with the second portion of said agglomerable layer comprising said larger agglomerates.

2. The imaging method of claim 1 wherein said agglomerable layer is between about 0.01 to about 2 microns thick and comprises particles of the same average size, said larger agglomerates of said agglomerable layer are present in a lower particle number density in said complementary image areas compared to the particle number density of the particles of the agglomerable layer in image configuration, and both are on and not embedded in said substrate.

3. The imaging method of claim 1 wherein said agglomerable layer comprises particles having average particle size not greater than about 1 micron.

4. The imaging method of claim 2 wherein said agglomerable layer particles comprise selenium.

5. The imaging method of claim 4 wherein said agglomerable layer particles comprise predominantly amorphous selenium.

6. The imaging method of claim 3 wherein said agglomerable layer comprises particles having average particle size not greater than about 0.5 microns.

7. The imaging method of claim 6 wherein said agglomerable particles have center to center particle spacings not greater than about ½ micron.

8. The imaging method of claim 2 wherein the imaged member was imaged by steps comprising imagewise exposing said agglomerable layer, which is capable of being agglomerated by electromagnetic radiation to which is exposed, to electromagnetic radiation of energy in the range of between about 0.001 and about 0.3 joules/cm$^2$.

9. The imaging method of claim 8 wherein said electromagnetic radiation is of wavelength in the range between about 2,000 Å and about 26,000 Å.

10. The imaging method of claim 9 wherein the imagewise exposure is carried out for a time period in the range between about 1 microsecond and about $10^4$ microseconds.

11. The imaging method of claim 10 wherein the source of said electromagnetic radiation is a Xenon gas discharge lamp.

12. The imaging method of claim 10 wherein the source of said electromagnetic radiation is a laser.

13. The imaging method of claim 1 wherein as a result of step (b) the agglomerable layer material density of the image configuration is reduced to below the density of the complementary image configuration comprising larger agglomerates.

14. The imaging method of claim 13 whereby as a result of step (b) an image of higher contrast density than the imaged member provided in step (a) is produced.

15. The imaging method of claim 13 wherein the agglomerable layer material of the image configuration has unaided human eye detectable density and wherein after step (b) the image configuration is devoid of agglomerable material density and is the density only of said substrate.

16. The imaging method of claim 15 wherein the density of the complementary image configuration as detected by the unaided human eye, is substantially unaffected by step (b).

17. The imaging method of claim 1 wherein said contacting is uniformly to the entire imaged surface of said imaged member, said contacting being sufficient to change the agglomerable layer in image configuration to a degree detectable to the unaided human eye, but insufficient to change the agglomerated portion of the agglomerable layer to a degree detectable by the unaided human eye.

18. An imaging method comprising:

(a) providing on a substrate an about 0.05 to about 5 micron thick layer of particles having an average diameter of from about 0.05 to about 5 microns and a center to center particle spacing of up to about 5 microns, said particles comprising material selected from the group consisting of amorphous selenium, amorphous selenium alloys, tellurium, mixtures of amorphous selenium and crystalline selenium, arsenic, zinc, sulfur, dyed polyvinyl carbozole, gallium, cobalt tricarbonyl, thermoplastics, dyed thermoplastics, dyed waxes and dyed paraffins;

(b) exposing at least a portion of the layer of particles to radiation of a wavelength between about 2,000 to about 26,000 Å at an energy level of about 0.001 to about 0.3 joules/cm$^2$ for about 1 to about $10^4$ microseconds, and (c) contacting said layer of particles with a composition selected from the group consisting of carbon disulfide, sodium sulfide, chromic acid and an alcohol solution of triphenyl phosphine.

* * * * *